US009267230B2

(12) United States Patent
Hahn

(10) Patent No.: US 9,267,230 B2
(45) Date of Patent: Feb. 23, 2016

(54) MANUAL PUMP FOR A HOUSEHOLD APPLIANCE SUCH AS AN IRON

(71) Applicant: ROWENTA WERKE GmbH, Offenbach (DE)

(72) Inventor: Matthias Hahn, Frankfurt (DE)

(73) Assignee: ROWENTA WERKE GmbH, Offenbach (DE)

( * ) Notice: Subject to any disclaimer, the term of this patent is extended or adjusted under 35 U.S.C. 154(b) by 0 days.

(21) Appl. No.: 14/489,989

(22) Filed: Sep. 18, 2014

(65) Prior Publication Data

US 2015/0075038 A1 Mar. 19, 2015

(30) Foreign Application Priority Data

Sep. 18, 2013 (FR) ..... 13 02164

(51) Int. Cl.

| | |
|---|---|
| ***D06F 75/22*** | (2006.01) |
| ***D06F 87/00*** | (2006.01) |
| ***D06F 75/18*** | (2006.01) |
| ***B05B 11/00*** | (2006.01) |
| *B65D 83/22* | (2006.01) |
| *F04B 53/14* | (2006.01) |

(52) U.S. Cl.

CPC ..... *D06F 75/18* (2013.01); *B05B 11/3015* (2013.01); *B05B 11/3059* (2013.01); *B05B 11/3077* (2013.01); *D06F 75/22* (2013.01); *D06F 87/00* (2013.01); *B05B 11/3074* (2013.01); *B65D 83/222* (2013.01)

(58) Field of Classification Search

CPC ..... D06F 87/00; D06F 75/22; B05B 9/085; B65D 83/222; B65D 83/226; B65D 83/228; F04B 53/14

USPC ..... 38/77.5

See application file for complete search history.

(56) References Cited

U.S. PATENT DOCUMENTS

| | | | | | |
|---|---|---|---|---|---|
| 1,231,442 | A | * | 6/1917 | Smith | 222/387 |
| 2,814,711 | A | * | 11/1957 | Plint | 337/347 |
| 3,218,742 | A | * | 11/1965 | Carabet et al. | 38/77.5 |
| 4,061,247 | A | * | 12/1977 | Meshberg | 222/1 |
| 4,149,327 | A | * | 4/1979 | Hammer et al. | 38/77.5 |
| 4,454,964 | A | * | 6/1984 | Sacher | 222/43 |
| 5,114,049 | A | * | 5/1992 | Knickerbocker | 222/153.01 |
| 6,671,985 | B2 | * | 1/2004 | Bouleau | 38/77.3 |

FOREIGN PATENT DOCUMENTS

| | | |
|---|---|---|
| GB | 1430359 | 9/1973 |

* cited by examiner

*Primary Examiner* — Ismael Izaguirre
(74) *Attorney, Agent, or Firm* — The Webb Law Firm

(57) ABSTRACT

Manual pump for a household appliance such as an iron, with an activation button that moves between a resting position, to which it is returned by a return mechanism, and a depressed position, into which it is moved by pressing the button to produce a pumping effect, characterized in that said pump has a stopping mechanism exerting a force against the movement of the button toward the depressed position when said button is in the resting position, said stopping mechanism being adjusted so that the force necessary to move the button into the depressed position is greater when the button is in the resting position than when it is not in said resting position.

8 Claims, 2 Drawing Sheets

MANUAL PUMP FOR A HOUSEHOLD APPLIANCE SUCH AS AN IRON

CROSS-REFERENCE TO RELATED APPLICATION

This application claims priority to French Patent Application No. 1302164 filed Sep. 18, 2013, the disclosure of which is hereby incorporated in its entirety by reference.

FIELD OF THE INVENTION

This invention pertains to a manual pump for a household appliance such as an iron, and relates more particularly to a manual pump that includes an activation button that moves between a resting position, to which it is returned by a return mechanism, and a depressed position, into which it is moved by pressing the button.

DESCRIPTION OF RELATED ART

There already exists, as described in patent application GB 1 430 359, an iron containing a water spraying device consisting of a manual pump with an activation button that moves between a resting position, to which it is returned by a return spring, and a depressed position, into which it is moved by pressing the button. The iron also includes a device for releasing extra steam, consisting of a similarly-constructed pump that is activated by a second button.

Such manual pumps offer the advantage of being simple and inexpensive to produce, thereby making it possible to offer an iron equipped with a spraying device and a device for releasing extra steam at a low cost. For the purpose of achieving proper ergonomics of use, the activation buttons on these pumps are generally positioned close to the handle, either at the forward upper end of the handle so that they can be activated easily with the thumb, or beneath the handle so that they can be activated with the index finger, like a trigger.

However, such activation buttons present the disadvantage of being very exposed, such that they may be hit involuntarily while the iron is being handled during an ironing session. And yet, even the partial activation of these buttons initiates the ejection of fluid by the pump. When the pump is combined with a spray nozzle, this causes the nozzle of the spraying mechanism to release a drop of water that could stain the fabric.

The aim of the following invention is to remedy this disadvantage.

SUMMARY OF THE INVENTION

To this end, the invention pertains to a manual pump for a household appliance such as an iron, consisting of an activation button that moves between a resting position, to which it is returned by a return mechanism, and a depressed position into which it is moved by pressing the button to produce the pumping effect, characterized in that the pump contains a stopping mechanism that exerts a force that prevents the button from moving into the depressed position when the button is in the resting position, the stopping mechanism being adjusted so that the force required to move the button into the depressed position is greater when the button is in the resting position than when it is not in the resting position.

The result is a stopping mechanism that works essentially when the piston is in the resting position, thus creating a hard point in the activation of the button in order to avoid any involuntary activation of the pump.

According to another characteristic of the invention, the pump has a body with a pumping chamber that receives a piston connected to a shaft and the stopping mechanism acts on the piston shaft.

According to another characteristic of the invention, the stopping mechanism is composed of a locking component that slides elastically into a groove cut into the shaft when the piston is in the resting position.

According to another characteristic of the invention, the locking component consists of an elastic ring, the ring being immobilized along the longitudinal axis of the piston by a support mechanism.

According to another characteristic of the invention, the pumping chamber contains an orifice through which the piston shaft is inserted, and the support mechanism consists of support claws positioned around the edge of the orifice.

According to another characteristic of the invention, the piston's return mechanism consists of a spring, and the locking component consists of a portion of the spring, which is in a shape that causes it to slide into in the groove when the piston is in the resting position.

According to another characteristic of the invention, the spring is a spiral spring with one folded end that slides into the groove when the piston is in the resting position.

The invention also pertains to an iron with a spray nozzle for spraying water, supplied by a manual pump described in the invention.

According to another characteristic of the invention, the appliance consists of an iron with a soleplate mounted beneath casing that is equipped with a handle, the spray nozzle being positioned on the forward surface of the iron.

According to another characteristic of the invention, the pump activation button is positioned near the forward end of the handle of the iron, at the tip of the handle, so that it can be activated with the thumb, or beneath the handle so that it can be activated with the index finger, like a trigger.

BRIEF DESCRIPTION OF THE DRAWINGS

The purposes, appearances and advantages of this invention are better understood according to the description provided below of several specific ways of implementing this invention, which are provided as non-limiting examples, in reference to the attached drawings, in which.

DETAILED DESCRIPTION OF THE INVENTION

Only the components necessary for understanding the invention are depicted. To make it easier to read the drawings, the same components are labeled with the same reference numbers from one drawing to the next.

Figure 1:
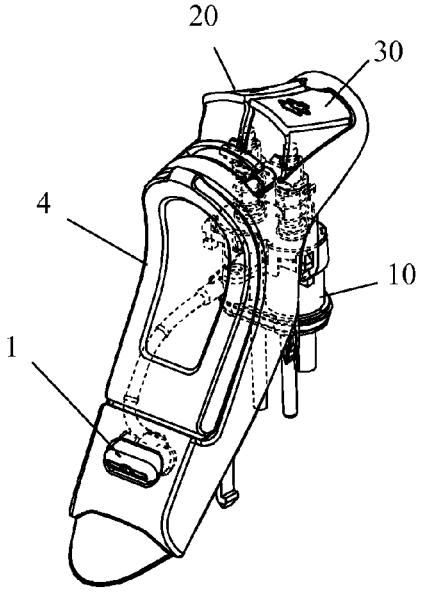
FIG. 1 is a perspective view of a portion of the front side of an iron according to one particular way of implementing the invention.

FIG. 1 depicts one portion of the front side of a steam iron, traditionally consisting of the soleplate, on top of which is mounted a heating body that contains a spray chamber, and a casing equipped with a handle, which are not depicted in the drawings.

According to this drawing, the front side has a spray nozzle (1) connected to a pumping device containing two manual pumps (2, 3) activated by a button (20, 30 respectively) positioned at one upper front end of the iron handle, the front side also containing a trap door (4) used to fill a reservoir housed in the casing of the iron, which are not depicted in the drawings.

Figure 2:
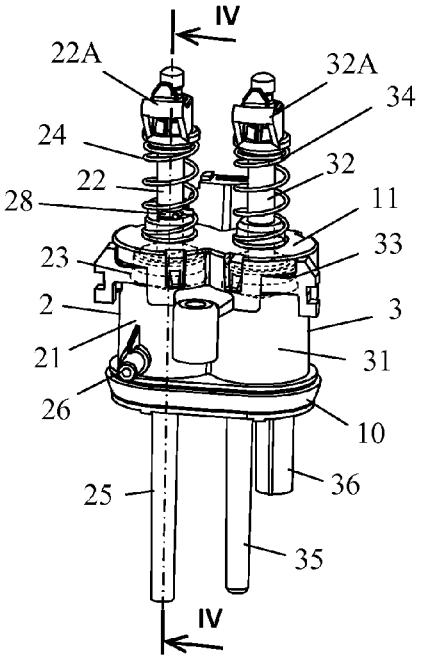
FIG. 2 is a perspective view of the pumping device with which the iron in FIG. 1 is equipped.

As can be seen in FIG. 2, the pumps (2, 3) each have a cylindrical pumping chamber (21, 31) receiving a piston (23, 33), depicted in dotted lines in this drawing, both pumping chambers (21, 31) being arranged in a single body (10), while positioned side by side, and having one open upper end that is closed by a cap (11).

The cap (11) has, in the extension of each pumping chamber (21, 31), an orifice (12, 13) through which a shaft (22, 32) is inserted, having one lower end attached to the piston (23, 33) and one upper end attached to a head (22A, 32A), on which the button (20, 30) is supported, the head (22A, 32A) having one lower surface subjected to the force of a return spring (24, 34) positioned between the head (22A, 32A) and the cap (11).

The pistons (23, 33) thus created move between a resting position, illustrated in FIG. 2, to which they are returned by the return spring (24, 34) and a depressed position, into which they are moved when the user presses Button 20 and Button 30, respectively.

By their very nature, the buttons (20, 30) move along with the pistons (23, 33) and are, for this purpose, ideally assembled to move along the axis of the pistons or carried by control levers mounted to pivot around an off-center axis, the buttons (20, 30) being able to move between a resting position, to which they are returned by the return spring (24, 34) and a depressed position corresponding to the depressed position of the pistons (23, 33).

Each pumping chamber (21, 31) has a bottom equipped with an intake conduit (25, 35) submersed in the iron's reservoir in order to draw out the water, one of the pumping chambers (21) containing an outlet conduit (26) connected by a tube to the spray nozzle (1) to allow a mist of water to be sprayed when the button (20) is pressed, the other pumping chamber (31) containing an outlet conduit (36) leading to a steam chamber not depicted in the drawings, in which extra steam is produced when the button (30) is pressed.

In the specific example of implementation illustrated in the drawings, the pump (2) connected to the spray nozzle (1) differs from the pump (1) connected to the steam chamber in that it contains a stopping mechanism that holds the piston (23) in the resting position, this stopping mechanism being ideally comprised of a ring (27) that slides elastically into a ring-shaped groove (28) cut into the shaft (22).

Figure 3:
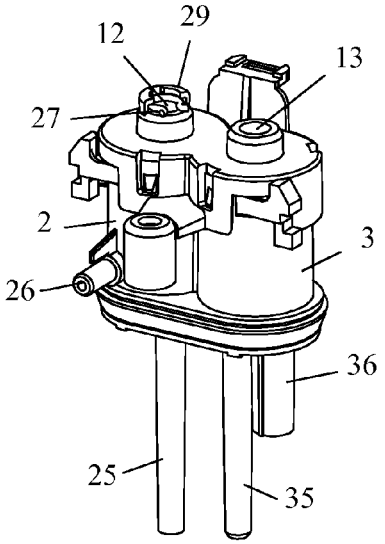
FIG. 3 is a perspective view of the body of the pumping device in FIG. 2.

As depicted in FIG. 3, the ring (27) takes the form of an elastic ring that is positioned at the outer edge of the orifice (12) and that is attached to the body (10) while being held, along the longitudinal axis of movement of the shaft (22), by support claws (29) placed on the cap (11) on the edge of the orifice, the support claws (29) defining a ring-shaped housing into which the ring (27) may bend radially to the shaft (22) while being held in place along the longitudinal direction of the shaft (22).

The operation of the pump (2) thus created will now be described.

Figure 5A:
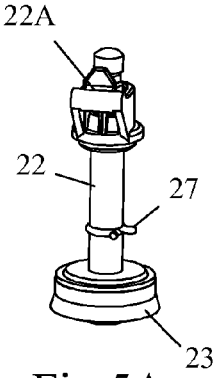
FIGS. 5A and 5B are perspective views of the piston equipping the pump connected to the spray nozzle when the piston is in the resting position and in the depressed position, respectively.
Figure 4A:
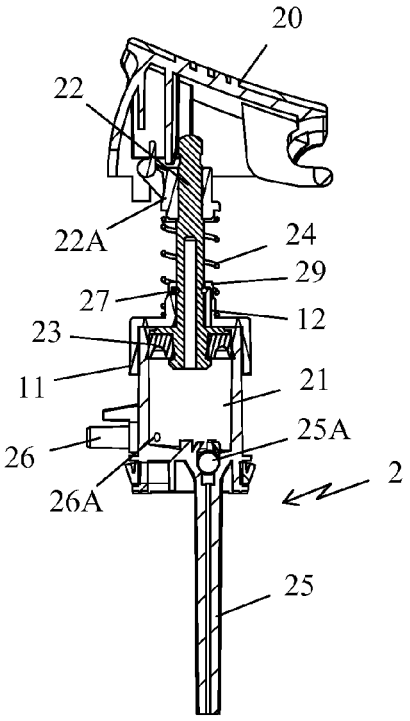
FIGS. 4A and 4B are cross-section views of the pumping device along Line IV-IV in FIG. 2 when the piston is in the resting position and in the depressed position, respectively.

As depicted in FIG. 4A, when the button (20) and the piston (23) are returned by the return spring (24) to the resting position, the piston (23) moves toward the top of the pumping chamber, such that the water in the reservoir is sucked through the intake conduit (25) in the pumping chamber (21). In this resting position, the groove (28) in the shaft (22) is facing the ring (27) such that the ring (27) slides into the groove (28), as is also depicted in FIG. 5A.

As a result, the ring (27) immobilizes the shaft (22) in the resting position, and the user must exert additional force on the button (20) in order to move the piston (23), this additional force being defined by the force necessary to elastically bend the ring (27) so that it opens enough to come out of the groove (28) and slide along the shaft (22).

Figure 5B:
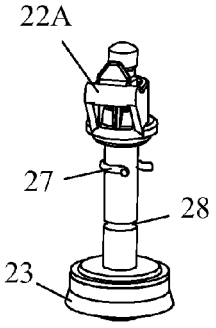
Figure 4B:
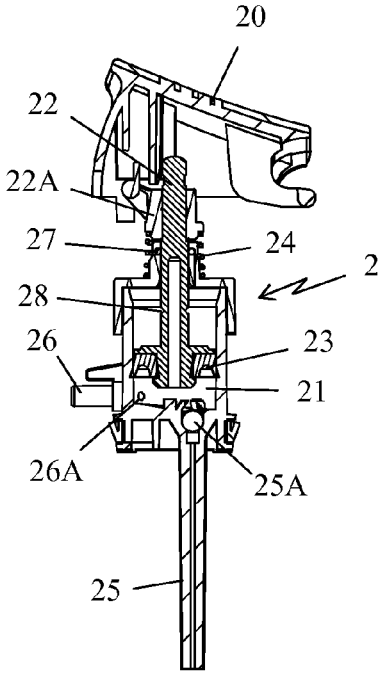

When the pressure exerted on the button (20) is enough to bend the ring (27), the piston (23) can slide downward, as depicted in FIG. 4B, and the ring (27) slides along the shaft (22), as depicted in FIG. 5B, generating only very little locking force, corresponding to the frictional force of the ring (27) on the shaft (22).

During this downward movement of the piston (23), the water in the pumping chamber (21) is pushed through the outlet conduit (26) via an outlet orifice (26A) positioned near the bottom of the pumping chamber (21), and then is sprayed by the nozzle (1), the intake conduit (25) having a ball valve (25A) preventing the water from returning to the reservoir.

When the user releases the button (20), the button (20) and the piston (23) are returned to their resting position by the return spring (24), and then are once again immobilized in this position by the insertion of the ring (27) into the groove (28).

A pump is thus obtained, in which the movement of the piston (23) has a hard point when the piston (23) is in the resting position, such that the button (20) of the pump (2) is more difficult to depress when it is in the resting position than when it has left the resting position.

Such a characteristic offers the advantage of preventing the involuntary activation of the pump, particularly when only slight pressure is exerted on the pump while the iron is being handled, thus preventing drops of water from coming out of the spray nozzle and staining the fabric.

Figure 6:
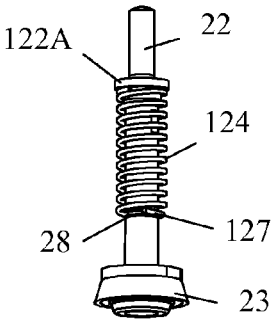
FIG. 6 is a perspective view of a piston equipped with a return spring according to a second method of implementing the invention.
Figure 8:
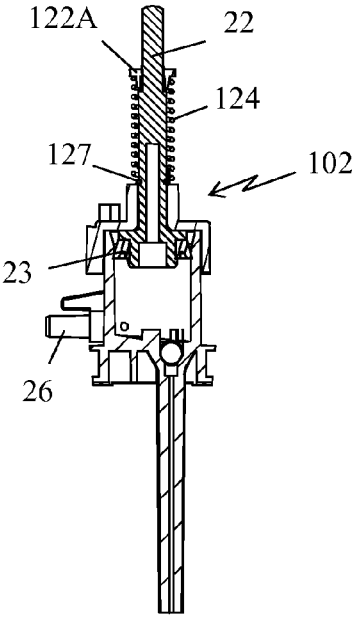
FIG. 8 is a cross-section view of the pump equipped with the piston in FIG. 6.
Figure 7:
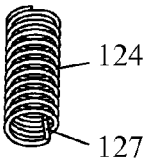
FIG. 7 is a perspective view of the spring equipping the piston in FIG. 6.

FIGS. 6 to 8 illustrate one variation of implementation, in which the piston (23) is equipped with a return spring (124) that performs both the function of returning the piston (23) to the resting position, and stopping the piston (23) in the resting position, such a variation of implementation offering the advantage of obtaining an equivalent result without using an independent elastic ring.

As shown in these drawings, in this variation of implementation, the return spring (124) is in the shape of a spiral spring with one lower end (127) that is curved inward, such that this lower end (127) slides inside the groove (28) of the shaft (22) when the piston (23) is in the resting position, as depicted in FIG. 6, the upper end of the spring (124) being attached to a spring retainer (122A) connected to the shaft (22).

The operation of a pump (102) thus created, as depicted in FIG. 8, is similar to the operation described for the first method of implementation, the curved lower end (127) of the return spring (124) playing the role of the elastic ring by sliding into the groove (28) when the piston (23) is in the resting position and coming out of the groove (28) to slide along the shaft (22) when enough pressure is exerted on the button (20). The curved lower end (127) therefore generates a stopping force when the piston (23) is in the resting position, which creates a hard point in the activation of the pump (102), thereby avoiding any involuntary activation of the pump (102).

Of course, the invention is in no way limited to the methods of implementation described and illustrated, which have been provided only as examples. It is still possible to make modifications, particularly with regard to the constitution of the various components or by substituting equivalent techniques, without necessarily falling outside the scope of protection of the invention.

Thus, in one variation of implementation that is not depicted, the stopping mechanism could also equip the pump used to generate extra steam, in order to avoid any untimely release of steam.

Thus, in one variation of implementation, the component controlling the pump could be positioned beneath the handle of the iron, in order to be activated using the index finger of the hand, like a trigger.

Thus, in another variation of implementation that is not depicted, the stopping mechanism could act directly on the activation button rather than on the shaft of the piston.

The invention claimed is:

1. Manual pump for a household appliance containing an activation button that moves between a resting position, to which it is returned by a return mechanism, and a depressed position into which it is moved by pressing the button to produce a pumping effect, wherein said pump has a stopping mechanism applying a force against the movement of the button into the depressed position when said button is in the resting position, said stopping mechanism being adjusted so that the force necessary to move the button into the depressed position is greater when the button is in the resting position than when it is not in the resting position, wherein the pump has a body with a pumping chamber receiving a piston attached to a shaft, and the stopping mechanism acts on the shaft of the piston, and wherein the stopping mechanism is comprised of a locking component that slides elastically into a groove cut into the shaft when the piston is in the resting position.

2. Manual pump described in claim 1, wherein said locking component consists of an elastic ring, said ring being immobilized along the longitudinal axis of the piston by a support mechanism.

3. Manual pump described in claim 2, wherein the pumping chamber has an orifice through which the shaft of the piston is inserted, and wherein the support mechanism consists of support claws positioned around the edge of the orifice.

4. Manual pump described in claim 1, wherein the piston return mechanism consists of a spring and wherein the locking component consists of one portion of the spring that is in a shape that makes said locking component slide into the groove when the piston is in the resting position.

5. Manual pump described in claim 4, wherein the spring is a spiral spring and wherein the spring has one bent end that slides into the groove when the piston is in the resting position.

6. Iron with a spray nozzle for spraying a mist of water, supplied by a manual pump as described in claim 1.

7. Iron described in claim 6, having an ironing soleplate mounted beneath a casing equipped with a handle, and wherein said spray nozzle is positioned on a front side of the iron.

8. Iron described in claim 7, wherein said button is positioned close to a front end of the iron handle, on a tip of the handle, in order to be activated with the thumb, or beneath the handle, in order to be activated by the index finger, like a trigger.

* * * * *